US008667761B2

(12) United States Patent
Micho et al.

(10) Patent No.: US 8,667,761 B2
(45) Date of Patent: Mar. 11, 2014

(54) DOOR FRAME HAVING DURABLE WOOD PORTIONS

(75) Inventors: Mark G. Micho, Grand Rapids, MI (US); Frank Rozgowski, Issaquah, WA (US)

(73) Assignee: G-M Wood Products, Newaygo, MI (US)

( * ) Notice: Subject to any disclaimer, the term of this patent is extended or adjusted under 35 U.S.C. 154(b) by 1060 days.

(21) Appl. No.: 12/022,418

(22) Filed: Jan. 30, 2008

(65) Prior Publication Data

US 2008/0178553 A1 Jul. 31, 2008

Related U.S. Application Data

(60) Provisional application No. 60/887,256, filed on Jan. 30, 2007.

(51) Int. Cl.
*E04C 2/38* (2006.01)

(52) U.S. Cl.
USPC ..... 52/656.4; 52/515

(58) Field of Classification Search
USPC ..... 52/656.4; 403/364, 381
See application file for complete search history.

(56) References Cited

U.S. PATENT DOCUMENTS

| | | | |
|---|---|---|---|
| 2,281,864 | A | 5/1940 | Toothacre |
| 2,292,301 | A | 8/1942 | Smith |
| 2,292,806 | A | 8/1942 | Toothcare |
| 2,781,559 | A | 2/1957 | Savoie |
| 2,854,843 | A | 10/1958 | Lamb |
| 2,898,642 | A | 8/1959 | Etling |
| 3,690,082 | A | 9/1972 | Byland |
| 3,769,773 | A | 11/1973 | Mochizuki |
| 3,808,759 | A | 5/1974 | Carmichael |
| 3,812,621 | A | 5/1974 | Ragland |
| 3,911,548 | A | 10/1975 | Perry |
| 4,068,433 | A | 1/1978 | Glover |
| 4,306,821 | A | 12/1981 | Moore |

(Continued)

FOREIGN PATENT DOCUMENTS

| | | |
|---|---|---|
| DE | 808 280 | 7/1951 |
| DE | 1 121 309 | 1/1962 |

(Continued)

OTHER PUBLICATIONS

"*Chamaecyparis nootkatensis*" Griffith, Randy Scott, U.S. Department of Agriculture, Forest Service published Jan. 1, 1992.

(Continued)

*Primary Examiner* — Brian Glessner
*Assistant Examiner* — Joshua Ihezie
(74) *Attorney, Agent, or Firm* — Price Heneveld LLP

(57) ABSTRACT

A frame for doors, windows, and the like of buildings includes upper and lower portions that are both made of wood. The upper portion of the frame is made of a conventional wood, and at least a portion of the lower portion of the frame is made of a wood that is naturally resistant to weathering, decay, rot, insects, or the like. According to other aspects of the present invention, other building components such as doors, trim, and the like may also be constructed utilizing different wood species for different parts of the component to provide different levels of rot and/or decay resistance for different parts of the component.

9 Claims, 2 Drawing Sheets

(56) References Cited

U.S. PATENT DOCUMENTS

| | | | | |
|---|---|---|---|---|
| 4,492,496 | A | 1/1985 | Arnold | |
| 4,509,294 | A | 4/1985 | Boilard | |
| 4,516,365 | A | 5/1985 | Chapman | |
| 4,543,764 | A | 10/1985 | Kozikowski | |
| 4,633,616 | A | 1/1987 | Giguere | |
| 4,644,722 | A | 2/1987 | Phillips | |
| 4,702,057 | A | 10/1987 | Phillips | |
| 4,779,389 | A | 10/1988 | Landers | |
| 4,823,529 | A | 4/1989 | Canfield et al. | |
| 4,866,901 | A | 9/1989 | Sanchez | |
| 4,892,601 | A | 1/1990 | Norwood | |
| 5,022,134 | A | 6/1991 | George | |
| 5,074,092 | A | 12/1991 | Norlander | |
| 5,175,973 | A | 1/1993 | Owen et al. | |
| 5,337,469 | A | 8/1994 | Richey | |
| 5,365,708 | A | 11/1994 | Winston | |
| 5,380,131 | A | 1/1995 | Crawford | |
| 5,426,894 | A | 6/1995 | Headrick | |
| 5,437,130 | A | 8/1995 | Raynak | |
| 5,501,054 | A | 3/1996 | Soltis et al. | |
| 5,516,236 | A | 5/1996 | Williams et al. | |
| 5,524,408 | A | 6/1996 | Richey | |
| 5,546,715 | A | 8/1996 | Edstrom | |
| RE35,322 | E | 9/1996 | Owen et al. | |
| 5,553,438 | A | 9/1996 | Hsu | |
| 5,573,354 | A | 11/1996 | Koch | |
| 5,586,796 | A | 12/1996 | Fraser | |
| 5,588,266 | A | 12/1996 | Headrick | |
| 5,611,173 | A | 3/1997 | Headrick et al. | |
| 5,649,397 | A | 7/1997 | Sander | |
| 5,661,943 | A * | 9/1997 | Hagel | 52/656.4 |
| 5,775,041 | A | 7/1998 | Tull et al. | |
| 5,813,800 | A | 9/1998 | Doleshal | |
| 5,829,920 | A | 11/1998 | Christenson | |
| 5,873,209 | A * | 2/1999 | Hagel | 52/656.4 |
| 5,950,391 | A * | 9/1999 | Hagel | 52/656.4 |
| 6,098,351 | A | 8/2000 | Mills | |
| 6,122,882 | A | 9/2000 | Hagel | |
| 6,231,931 | B1 * | 5/2001 | Blazey et al. | 427/508 |
| 6,425,222 | B1 | 7/2002 | Hagel | |
| 6,446,410 | B1 * | 9/2002 | Hagel | 52/717.01 |
| 6,694,696 | B2 | 2/2004 | Hagel | |
| 6,701,984 | B2 * | 3/2004 | Lamontagne et al. | 144/347 |
| 6,837,018 | B1 | 1/2005 | Hagel et al. | |
| 6,860,071 | B2 * | 3/2005 | Weaber et al. | 52/179 |
| 7,100,339 | B2 | 9/2006 | Hagel | |
| 7,222,587 | B2 | 5/2007 | Hagel | |
| 2002/0076275 | A1 * | 6/2002 | Hernandez et al. | 403/364 |
| 2002/0117272 | A1 * | 8/2002 | Lee | 160/236 |
| 2003/0005652 | A1 | 1/2003 | Hagel | |
| 2004/0206033 | A1 | 10/2004 | Hagel | |
| 2004/0221523 | A1 | 11/2004 | Hagel | |
| 2005/0066608 | A1 * | 3/2005 | Stollenwerk et al. | 52/633 |

FOREIGN PATENT DOCUMENTS

| | | | | |
|---|---|---|---|---|
| DE | 4002830 | | 9/1990 | E04H 17/20 |
| EP | 0 466 292 | A1 | 1/1992 | E04H 12/22 |
| EP | 0 550 089 | A1 | 7/1993 | E06B 1/52 |
| EP | 0 586 212 | | 3/1994 | C08L 27/06 |
| EP | 1 007 816 | B1 | 6/2000 | E06B 3/988 |
| FR | 2 617 081 | A1 | 12/1988 | B27F 4/00 |
| FR | 2 652 298 | | 3/1991 | B27M 3/00 |
| FR | 2 652 298 | A1 | 3/1991 | B27M 3/00 |
| GB | 2 112 437 | A | 7/1983 | E06B 1/06 |
| JP | 50-132102 | A | 10/1975 | |
| JP | 52-108270 | U | 8/1977 | |
| JP | 61-90978 | | 6/1986 | E06B 3/96 |
| JP | 4-174186 | | 6/1992 | E06B 1/52 |
| JP | 5-237921 | | 9/1993 | E06B 1/52 |
| JP | 06088418 | | 3/1994 | E04F 15/04 |
| JP | 7-91142 | | 4/1995 | E06B 1/52 |
| NL | 8802254 | | 9/1988 | E06B 3/96 |
| NL | 9102135 | | 7/1993 | E06B 3/984 |
| NL | 1002780 | C | 6/1997 | |
| NL | 8900224 | | 8/1999 | E06B 1/34 |
| WO | WO 98/11464 | | 3/1998 | G02B 7/182 |
| WO | WO 00/49242 | | 8/2000 | E04C 2/38 |

OTHER PUBLICATIONS

Wood Handbook, Wood as an Engineering Material, Gent. Tech. Rep. FPL-GTR-113, USDA Forest Service, Forest Products Laboratory, Madison, Wisconsin., Mar. 1999.

* cited by examiner

DOOR FRAME HAVING DURABLE WOOD PORTIONS

CROSS-REFERENCE TO RELATED APPLICATIONS

This application claims the benefit of U.S. Provisional Application No. 60/887,256, filed on Jan. 30, 2007, entitled DOOR FRAME HAVING DURABLE WOOD PORTIONS, the entire contents of which are incorporated by reference.

BACKGROUND OF THE INVENTION

Various types of frames for doors, windows, and the like for houses and other buildings have been developed. A known type of door and window frame construction utilizes conventional species of wood such as pine or poplar. The wood may be made up of smaller pieces of wood that have been finger jointed together. In general, frame members that are made from finger jointed wood are lower cost than if a one-piece member were utilized to make the individual frame members. Such frames are generally primed and painted, and the finger joints are therefore not visible, and do not detract from the appearance of the finished product.

Window and door frames are normally exposed to moisture and other environmental factors, and the resulting decay, rotting, insect damage, and other deterioration of the wood has been a problem. Various frame constructions have been developed in an attempt to solve the problems associated with decay and deterioration of window and door frames. In general, known pressure-treated wood is not suitable for window and door frames because the compounds utilized to treat the wood interfere with paint that is applied to the treated wood, thereby making it difficult or impossible to provide a painted surface having the desired appearance.

U.S. Pat. Nos. 5,873,209; 5,661,943; 6,122,882; and 6,446,410 disclose door frames and other products having upper wood portions and lower portions made of an extruded wood-based product such as Strandex®, ERT®, Trex® or the like that are finger jointed to the wood upper portions. Although this arrangement does provide a degree of environmental resistance, the dissimilarity of the materials used in the upper and lower portions of the frames may cause difficulty in terms of applying coatings such as primer and/or paint.

Hence, a frame for doors, windows, and the like alleviating the disadvantages of known frames would be advantageous.

SUMMARY OF THE INVENTION

One aspect of the present invention is a construction component such as a frame for doors, windows, and the like having a plurality of frame members that are joined together to form a door or window frame. The frame includes an upper portion made of a conventional wood species such as red pine or the like. Lower portions of the frame are made from a highly weather, decay and rot resistant wood such as Alaskan yellow cypress, or other wood from the cypress family having the desired degree of decay resistance. Because the upper and lower portions of the frame are both made of wood, primers, paints, and other coatings adhere to both portions of the frame, and provide a finished product that is durable with respect to both the wood frame itself, and the coatings on the frame. The red pine or other conventional wood utilized in the upper portions of the frame is relatively inexpensive, thereby reducing the overall cost of the frame. The Alaskan yellow cypress or other such weather-resistant wood is preferably only used in the lower portions of the frame which are more heavily exposed to moisture and the like that would otherwise lead to decay of the wood frame. In addition to door and window frames, other components such as doors, siding, exterior trim, and the like may also be constructed using a combination of conventional wood and weather-resistant wood.

These and other features, advantages, and objects of the present invention will be further understood and appreciated by those skilled in the art by reference to the following specification, claims, and appended drawings.

BRIEF DESCRIPTION OF THE DRAWINGS

FIG. 1.

DETAILED DESCRIPTION OF PREFERRED EMBODIMENT

Figure 1:
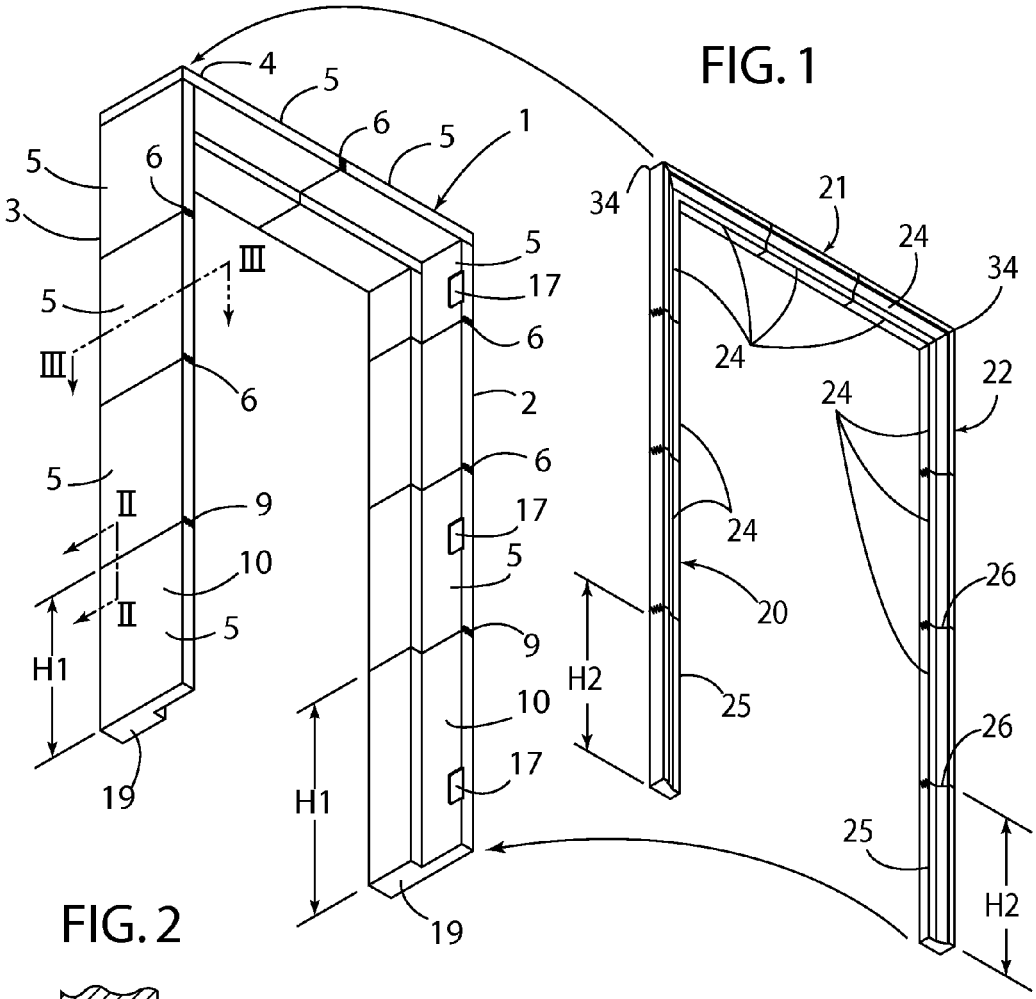
FIG. 1 is an isometric view of a door frame according to one aspect of the present invention.
Figure 2:
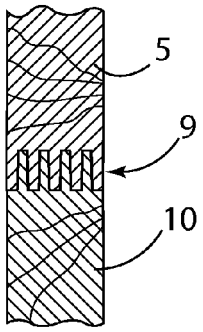
FIG. 2 is a cross-sectional view of a portion of the door frame of FIG. 1, taken along the line I-I.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

A door frame 1 (FIG. 1) according to one aspect of the present invention includes upright side frame members 2 and 3, and an upper frame member 4 extending between and interconnecting the side frame members 2 and 3. The side frame members 2 and 3, and the upper frame member 4, each include a plurality of individual upper pieces of wood 5 that are connected together at finger joints 6. The upper pieces of wood 5 are made of a conventional wood material such as red pine or the like used for constructing frames or other wood structures of houses. Although conventional wood species are relatively low cost and provide the desired structural strength, such wood generally provides limited weather and decay resistance.

In addition to the upper pieces of wood 5, the upright side frames 2 and 3 also include a decay-resistant lower piece of wood 10 that is connected to an adjacent upper piece of wood 5 by a finger joint 9. The decay-resistant lower pieces of wood 10 are preferably made of an Alaskan yellow cypress wood (chamaecyparis nootkatensis) that is highly resistant to decay, rot, insect damage and other degradation due to moisture and/or other weather or environmental conditions. As discussed in more detail below, molding or trim pieces 20, 21, and 22 made of two dissimilar species of wood may be secured to the door frame 1 when installed to a building structure.

The finger joint 9 interconnecting the upper wood pieces 5 with the decay-resistant lower wood pieces 10 may be a conventional finger joint that utilizes known waterproof or weather/moisture-resistant glue of a type previously used for finger joints. A conventional finger joint 9 is preferred because the tooling and techniques for forming such a joint are known, and such joints have proven to be suitable for many applications. Nevertheless, virtually any suitable joint configuration could be utilized to interconnect the upper pieces of wood 5 to the decay-resistant lower pieces of wood 10. For example, dovetails, dowels, mechanical connectors, or virtually any other connection arrangement may also be utilized.

A preferred wood for the decay-resistant lower wood pieces 10 is an Alaskan yellow cypress. This wood is extremely resistant to decay due to the naturally-occurring compounds in the wood. The Alaskan yellow cypress wood utilized to make the decay-resistant lower pieces of wood 10 is grown under conditions causing the tree to have a very slow growth rate, leading to relatively small growth rings and a high concentration of the naturally-occurring compounds that provide the weather and decay resistance of the wood. Although Alaskan yellow cypress is the preferred wood, other decay-resistant woods are also suitable for the decay-resistant lower pieces of wood 10. For example, the Wood Handbook-Wood as an Engineering Material, Gen. Tech. Rep. FPL-GTR-113, U.S. Department of Agriculture, Forest Service, Forest Products Laboratory lists various species as "resistant or very resistant" in Table 3 (page 3-18). In general, any wood having the required degree of decay resistance may be used for the decay-resistant lower pieces of wood 10. In general, the decay resistance of a particular piece of wood depends not only upon the species of wood, but the conditions under which the tree was grown. Accordingly, the species of wood and growth conditions are factors affecting the decay resistance of the wood.

As discussed above, the upper pieces of wood 5 may be made of a wood that has lower weather and decay resistance. Although red pine is presently a preferred wood, other woods such as radiator pine, eastern white pine, ponderosa pine, elliotis pine, or other pines, poplars, or other species are also suitable. It will be understood that the upper pieces of wood 5 are not limited to these species, and these species are merely examples of wood species that are suitable for making the upper pieces of wood 5.

Although the size of the decay-resistant lower wood pieces 10 may vary according to the requirements of a particular application, the overall height "H1" (FIG. 1) of the lower pieces of wood is preferably about 4 inches to about 10 inches, but may be as large as 24 inches or as small as 1 inch. A plurality of pockets 17 may be formed in the wood pieces and/or 10 to accommodate door hinges.

Figure 3:
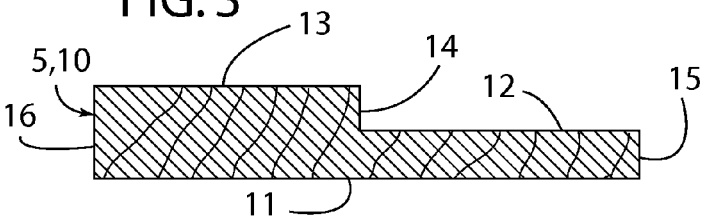
FIG. 3 is a cross-sectional view of the door frame of FIG. 1, taken along the line III-III.

With further reference to FIG. 3, the pieces of wood 5 and 10 generally have a flat outer surface 11, and inner surfaces 12 and 13, with a transverse surface 14 extending between the inner surfaces 12 and 13 to form a stop. End surfaces 15 and 16 extend between the outer surface 11, and the inner surfaces 12 and 13, respectively. In general, the upper frame member 4 will have a cross-sectional shape that is substantially the same as the cross-sectional shape of the side frame members 2 and 3. However, it will be understood that the cross-sectional shape of the wood pieces 5 and 10 will vary depending upon the particular type of frame or other component that is being fabricated, and the frame members need not have identical cross-sectional shapes. For example, a frame member of a garage door frame will generally have a cross-sectional shape configured to accommodate a garage door, and window frames have a cross-sectional shape as required to accommodate a particular type of window.

The surfaces 11-16 of the frame members 2, 3, and 4 are preferably coated with a primer having moisture and weather-resistant properties. A preferred primer is a latex acrylic primer available from Sherwin-Williams. It will be understood that other suitable primers may be utilized, and this primer is simply an example of a suitable primer. The frame members 2, 3, and 4 may then be painted as required to provide a finished appearance that is appropriate for the house or other building structure in which the door frame 1 is installed. In general, door frame 1 is painted after it is installed in a building, but it could be pre-painted prior to installation. The upper pieces of wood 5 and lower pieces of wood 10 preferably have substantially similar properties with respect to absorption/adherence of primer and paint, such that the primer and/or paint form a durable, substantially uniform coating over the entire door frame 1. This provides a substantially uniform appearance without requiring special treatment of wood pieces 5 and/or 10. Also, because the wood pieces 5 and 10 have the same or similar properties with respect to absorption and/or adhesion of the primer and/or paint coating, the wood pieces 5 and 10 tend to retain a substantially similar appearance over time.

Referring again to FIG. 1, the decay-resistant lower pieces of wood 10 define lower end surfaces 19. The end surfaces 19 are coated with an end-sealing primer/sealant to reduce or prevent wicking or other entry of moisture. In a preferred embodiment, the lower ends 19 are coated with an acrylic latex resin available from Western Coatings, Inc. Although the wood utilized to make the pieces 10 is highly weather and decay resistant, coating the lower ends 19 with a sealant further protects the wood and prevents or reduces absorption of moisture.

Moldings 20, 21, and 22 (FIG. 1) may be secured to the door frame 1 when the door frame 1 is secured to a building structure. The vertical mold pieces 20 and 22 may include a plurality of individual pieces 24 made of pine or the like, ad a lower piece 25 made of a more durable wood species. Upper mold piece 21 may include a plurality of wood pieces 24 that are all made of a wood species such as pine, or the like. The wood pieces 24 and 26 are interconnected at a plurality of finger joints 26. The lower pieces 25 have a height "H2" that is the same as the height "H1" of the lower pieces of wood 10 of door frame 1.

Figure 4:
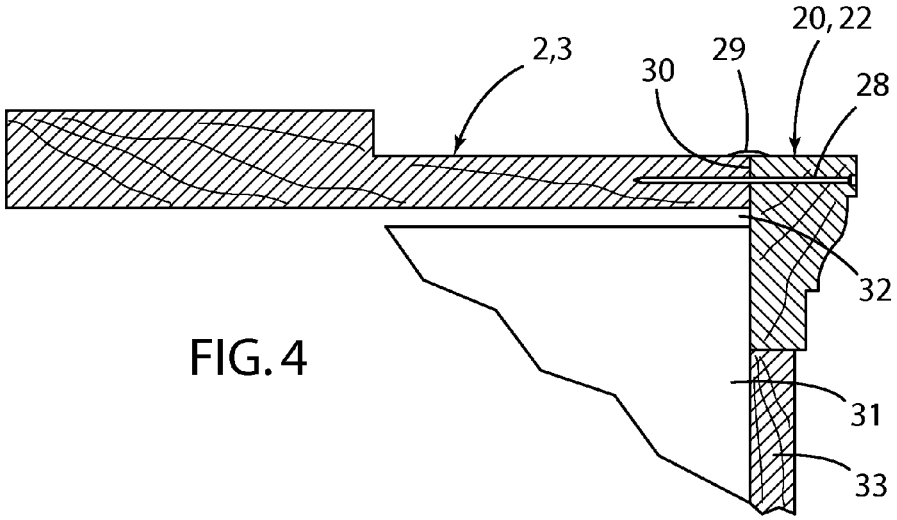
FIG. 4 is a fragmentary cross-sectional view of the door frame of FIG. 1.

With reference to FIG. 4, the vertical mold pieces 20 and 22 are secured to the upright side frame members 2 and 3 utilizing mechanical fasteners 28 such as nails, staples, or the like, and silicone caulk or the like 29 may be utilized to seal the joint 30 between the mold pieces 20 and 22 and the upright side frame members 2 and 3. The vertical mold pieces 20 and 22 extend across a gap 32 formed between building structure 31 and upright side frame members 2 and 3. Siding 33 or the like may be attached to the building structure in a known manner adjacent the mold pieces 20 and 22. In the illustrated example, the mold pieces 20-22 comprise a WM-180 brick molding. However, other trim or molding profiles or shapes may also be utilized.

The vertical mold pieces 20 and 22 preferably include a first wood species such as pine, or the like for the upper pieces 24, and the lower pieces 25 are preferably made of Alaskan yellow cedar (chamaecyparis nootkatensis) or other suitable wood having rot and decay resistance. In the illustrated example, the door frame 1 and the molding pieces 20-22 are both made of two different species of wood. However, it will be understood that the mold pieces 20 and 22 may be utilized with conventional door frames that do not include two different wood species. Also, the door frame 1 may be utilized with moldings made of palmer, or the like. Furthermore, although the moldings 20 and 22 are shown in connection with a door frame 1, it will be understood that the moldings 20 and 22 may be utilized to trim windows, or other structural features as required. Furthermore, if utilized for a window the like having a lower trim member (not shown), the lower trim member may be made entirely of Alaskan yellow cedar or the like. In this configuration, the uppermost trim member may be made of pine or the like, the vertical side trim members may be made of two different wood species joined together, and the lowermost trim member may be made entirely of a decay/rot resistance wood such as Alaskan yellow cedar.

The door frame and/or moldings or other components of the present invention are both cost-effective and weather resistant. The use of weather-resistant wood in the lower portions of the frame or other component (or other portions of the frame exposed to moisture, weather, and the like) alleviates the problems associated with the use of dissimilar frame materials. A wood frame or other building component constructed according to the present invention can be primed and painted in substantially the same manner as existing all wood frames, made of a single wood species. The frame and other components of the present invention are highly durable, yet very cost-effective due to the limited use of the more costly weather-resistant wood.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A door frame construction, comprising:

first and second generally upright side frame members, each defining upper and lower end portions;

an upper frame member extending between the first and second upright side frame members, the upper frame member having opposite end portions thereof connected to the first and second upright side frame members adjacent the upper end portions of the upright side frame members;

the first and second upright side frame members each include upper portions made of a first species of wood having a first resistance to decay, and lower portions made of a second species of wood having a second resistance to decay that is substantially greater than the first resistance to decay, and wherein the first and second species of wood have substantially similar properties with respect to absorption/adherence of primer; and a coating of primer on the upper and lower portions of the upright side frame members, the upper and lower portions having a substantially uniform appearance.

2. The door frame construction of claim 1, wherein:

the first species of wood is pine.

3. The door frame construction of claim 1, wherein:

the second wood species is selected from the group consisting of cedar and cypress.

4. The door frame construction of claim 1, wherein:

the second wood species is chamaecyparis nootkatensis.

5. The door frame construction of claim 1, wherein:

the upright side frame members comprise a plurality of individual pieces of wood.

6. The door frame construction of claim 5, including:

a plurality of finger joints interconnecting the individual pieces of wood.

7. The door frame construction of claim 1, wherein:

the upright side frame members define inner faces, each including generally planar first and second surface portions, and a third surface portion extending transversely between the first and second surface portions to form a door stop.

8. The door frame construction of claim 1, wherein:

both of the upright side frame members have substantially the same cross-sectional shape.

9. A door frame construction comprising:

first and second generally upright side frame members, each defining upper and lower end portions;

an upper frame member extending between the first and second upright side frame members, the upper frame member having opposite end portions thereof connected to the first and second upright side frame members adjacent the upper end portions of the upright side frame members: and wherein:

the first and second upright side frame members each include upper portions made of a first species of wood having a first resistance to decay, and lower portions made of a second species of wood having a second resistance to decay that is substantially greater than the first resistance to decay;

the upright side frame members are coated with primer: and the upper and lower portions of the side frame members have substantially similar properties with respect to absorption and adherence of the primer such that the upper and lower portions of the side frame members retain a substantially similar appearance over time.

* * * * *